US005885133A

United States Patent [19]

Williams, Jr.

[11] Patent Number: 5,885,133

[45] Date of Patent: Mar. 23, 1999

[54] APPARATUS AND METHOD FOR CLEANING TUBULAR MEMBERS

[75] Inventor: Robert V. Williams, Jr., Houston, Tex.

[73] Assignee: AbClean America, Inc., La Porte, Tex.

[21] Appl. No.: 843,360

[22] Filed: Apr. 15, 1997

Related U.S. Application Data

[62] Division of Ser. No. 262,742, Jun. 20, 1994, Pat. No. 5,664,992.

[51] Int. Cl.[6] ..... B24B 1/00; B24C 1/00

[52] U.S. Cl. ..... 451/40; 451/28

[58] Field of Search ..... 451/28, 40, 57, 451/61, 65, 75, 76, 102; 134/7, 32, 12.11, 12.12, 167 C, 172, 169 C, 166 C, 168 C; 239/336; 83/169, 177

[56] References Cited

U.S. PATENT DOCUMENTS

| | | | |
|---|---|---|---|
| 1,756,378 | 4/1930 | Oberhuber . | |
| 1,806,478 | 5/1931 | Long . | |
| 1,855,646 | 4/1932 | Oberhuber . | |
| 2,089,597 | 8/1937 | Carter | 451/76 |
| 2,117,648 | 5/1938 | Bottorf | 451/76 |
| 2,289,109 | 7/1942 | Edwards et al. . | |
| 2,358,557 | 9/1944 | Boyd et al. | 451/76 |
| 2,739,424 | 3/1956 | Fritze | 451/38 |
| 2,821,814 | 2/1958 | Fritze | 451/76 |
| 3,109,262 | 11/1963 | Weaver et al. | 451/76 |
| 3,120,237 | 2/1964 | Lang . | |
| 3,139,711 | 7/1964 | Soderberg, Jr. . | |
| 3,409,031 | 11/1968 | Benbow et al. . | |
| 3,659,305 | 5/1972 | Powers . | |
| 3,667,544 | 6/1972 | Allimon . | |
| 3,875,606 | 4/1975 | Landers . | |
| 3,900,912 | 8/1975 | Lenz et al. . | |
| 4,050,384 | 9/1977 | Chapman . | |
| 4,064,293 | 12/1977 | Nicklas | 451/76 |
| 4,069,535 | 1/1978 | Cato . | |
| 4,180,948 | 1/1980 | Stoltz | 451/76 |
| 4,203,778 | 5/1980 | Nunciato . | |
| 4,297,147 | 10/1981 | Nunciato et al. . | |
| 4,328,930 | 5/1982 | Kalendovsky . | |
| 4,380,477 | 4/1983 | Saunders | 451/76 |
| 4,497,664 | 2/1985 | Verry . | |
| 4,656,685 | 4/1987 | Wood . | |
| 4,800,104 | 1/1989 | Chuckshank | 451/76 |
| 4,815,241 | 3/1989 | Woodson . | |
| 4,817,342 | 4/1989 | Martin et al. . | |
| 4,821,467 | 4/1989 | Woodson et al. . | |
| 4,827,680 | 5/1989 | Rushing et al. | 451/38 |
| 4,878,320 | 11/1989 | Woodson . | |
| 4,909,325 | 3/1990 | Hopmann | 134/22.12 |
| 4,922,664 | 5/1990 | Spinks et al. . | |
| 4,995,201 | 2/1991 | von Borcke et al. . | |
| 5,002,120 | 3/1991 | Boisture et al. | 165/95 |
| 5,018,544 | 5/1991 | Boisture et al. | 134/111 |
| 5,031,691 | 7/1991 | Boisture | 134/167 |
| 5,067,558 | 11/1991 | Boisture | 134/167 |
| 5,123,206 | 6/1992 | Woodson . | |
| 5,160,548 | 11/1992 | Boisture | 451/36 |
| 5,375,376 | 12/1994 | Rooney | 451/40 |
| 5,674,323 | 10/1997 | Garcia | 134/167 C |

FOREIGN PATENT DOCUMENTS

| | | | |
|---|---|---|---|
| 1503901 | 7/1969 | Germany . | |
| 8701676 | 2/1989 | Netherlands | 451/40 |
| 236698 | 11/1969 | U.S.S.R. . | |
| 521033 | 9/1976 | U.S.S.R. . | |
| 632414 | 11/1978 | U.S.S.R. . | |

OTHER PUBLICATIONS

Brochure: "Sandjet: Heat Exchanger Cleaning Service," Ucisco, Houston, Texas.

*Primary Examiner*—David A. Scherbel
*Assistant Examiner*—Derris H. Banks
*Attorney, Agent, or Firm*—Browning Bushman

[57] ABSTRACT

An apparatus and method for cleaning a tubular member having an entrance end and an interior wall including a source of pressurized gas/solids mixture, a source of pressurized liquid medium, a conveying tube to introduce the pressurized liquid medium into the tubular member through an acceleration locus interiorly of the tubular member from the particulate solids being entrained and accelerated by the accelerated liquid medium substantially at the point of the acceleration locus whereby in situ mixing of the particulate solids and liquid medium occurs just prior to contacting the surface to be cleaned.

8 Claims, 3 Drawing Sheets

FIG. 1
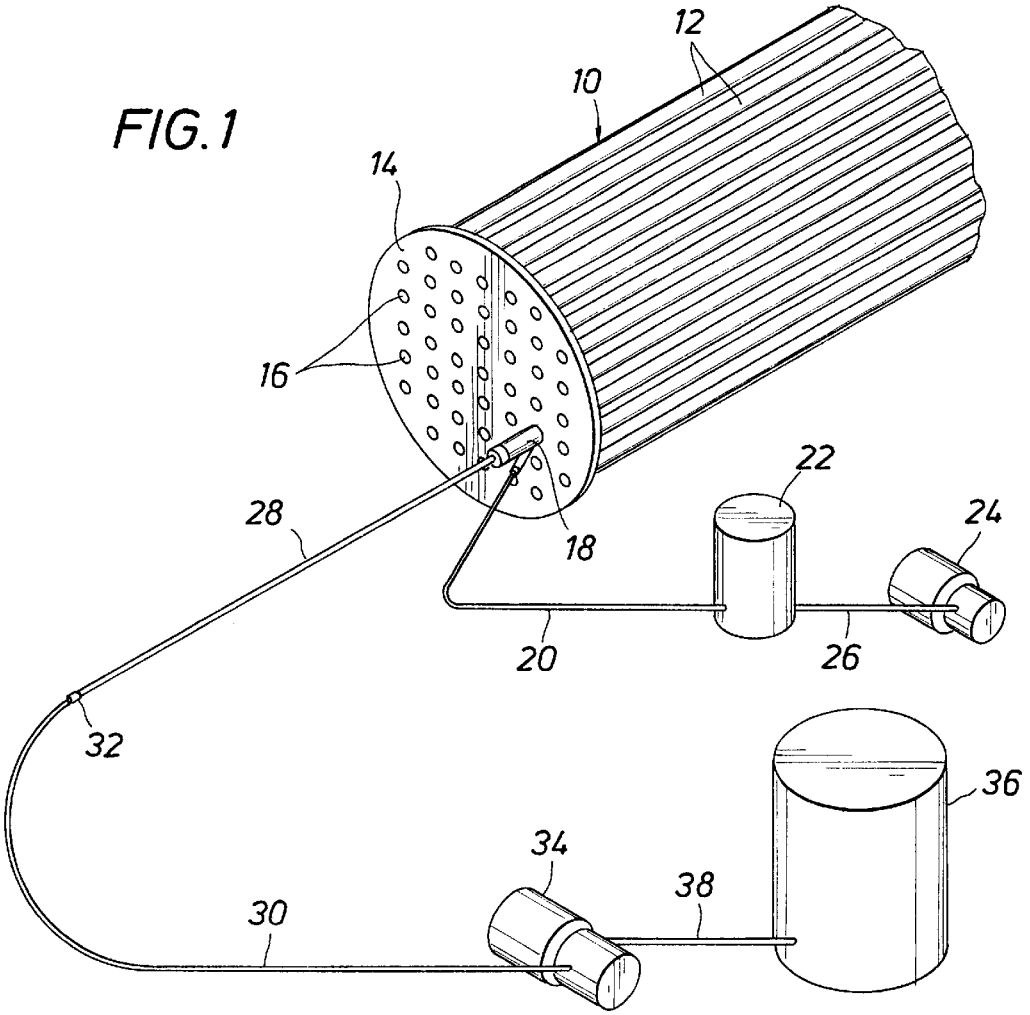
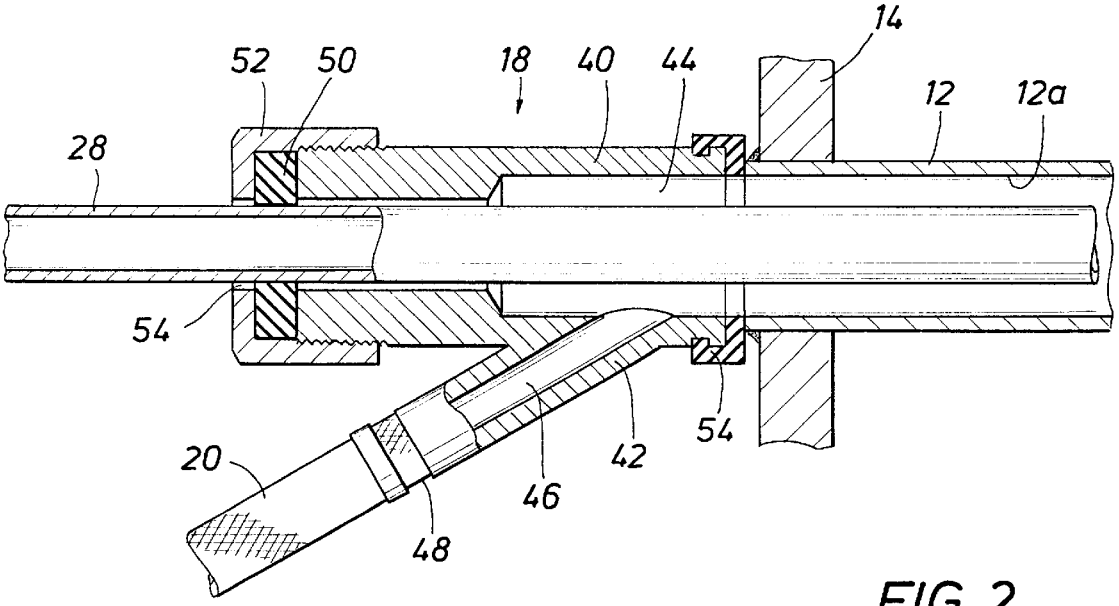
FIG. 2

APPARATUS AND METHOD FOR CLEANING TUBULAR MEMBERS

This is a divisional of application(s) Ser. No. 08/262,742, filed on Jun. 20, 1994, now U.S. Pat. No. 5,664,992.

BACKGROUND OF THE INVENTION

1. Field of the Invention

The present invention relates to an apparatus and method for cleaning a tubular member. More particularly, the present invention relates to an apparatus and method for cleaning a tubular member employing a mixture of a liquid medium and particulate solids.

2. Description of the Prior Art

The interior surface of tubes, pipes, and other tubular members are often cleaned using particulate solids/gas mixtures, liquid mediums such as water, or slurries of particulate solids and liquid mediums. An example of a typical use of these cleaning techniques is the cleaning of the tubes in the tube bundles of heat exchangers commonly used in chemical plants, refineries, and the like.

Generally speaking, the interior of a tubular member such as a heat exchanger tube can be cleaned by forcing a pressurized cleaning medium, e.g.—pressurized gas/particulate solid mixture, water, water/solid slurry—through the tubular member. In this type of cleaning, there is essentially no focusing of the cleaning medium radially outward against the walls of the tubular member, but rather unwanted coatings on the interior wall are removed as the cleaning material moves longitudinally through the tubular member. In an alternative method, a wand or lance can be inserted into the tubular member, the cleaning medium being delivered through the free end of the lance interiorly of the tubular member, the free end generally including a nozzle that serves to accelerate the cleaning medium and direct it radially outwardly against the interior wall of the tubular member.

The use of pressurized gas/particulate solids mixtures—e.g., compressed air and sand—suffers from the disadvantage that as a practical matter the solid particles cannot be accelerated to speeds greater than about 400–500 mph. On the other hand, if the solids are present as a slurry—e.g., in water—they can easily be accelerated to speeds of three to four times that in air. Since the work done by each solid (abrasive) particle is directly related to the kinetic energy of the particle at the time of impact and since kinetic energy is (mass)(velocity)$^2$, it is apparent that impact velocity should be as high as possible to achieve maximum cleaning effectiveness.

In recent years, the use of slurries of water-soluble solids and water as cleaning mediums has become fashionable, primarily because since the solids are water-soluble, clean-up problems are greatly reduced once the cleaning job has been completed. However, these water-soluble solids or abrasives are inherently softer than water-insoluble solids or abrasives. Accordingly, the longer these slurries of water-soluble solids and water remain together and are "handled," the less effective the solids become as cleaning agents because of the fact that, due to attrition and dissolution, they lose the sharp edges and other sharp formations (cutting surfaces) they may possess. Thus, in a typical cleaning system for cleaning tubular members forming heat-exchanger bundles, the particulate solids/water slurry is typically pumped from a holding tank through a lance or other elongate member that can be inserted into the tubular member being cleaned, the slurry then being forced through nozzles that force the slurry in a radially outward pattern against the walls of the tubular member to effect the cleaning. This method necessarily means that the particulate solids in the slurry are in contact with the water for a significant length of time and, moreover, because of being pumped and conveyed through hoses or the like, are subjected to high turbulence, leading to erosion of the cutting surfaces on the particulate solids.

SUMMARY OF THE INVENTION

It is therefore an object of the present invention to provide an apparatus for cleaning the interior of tubular members.

Another object of the present invention is to provide an apparatus for cleaning the interior of tubular members wherein in situ mixing of particulate solids and liquid medium occurs just prior to impacting the surface to be cleaned.

Yet a further object of the present invention is to provide a method of cleaning the interior surfaces or walls of tubular members wherein the particulate solids are kept separated from the liquid medium until just prior to being impacted against the walls of the tubular member to be cleaned.

Yet a further object of the present invention is to provide a method for cleaning the interior of a tubular member in which particulate solids are admixed with and accelerated by a liquid medium in a radially outward pattern against the interior wall of the tubular member, such admixing and acceleration occurring just prior to the particulate solids' impacting the interior wall of the tubular member.

The above and other objects of the present invention will become apparent from the drawings, the description given herein, and the appended claims.

In one embodiment, the present invention provides an apparatus for cleaning a tubular member that has an entrance end and an interior wall. The apparatus includes a source of a pressurized gas/particulate solids mixture and a source of a pressurized liquid medium. Means are provided to introduce the pressurized liquid medium into the tubular member, such means comprising a conveying tube having a first end that extends into the tubular member and a head assembly connected to the first end of the conveying tube, the head assembly including a first nozzle means that directs liquid medium into the tubular member at an angle of 90° or less to the direction of flow of the liquid medium in the conveying tube while also accelerating the liquid medium. There are also provided means for introducing the pressurized gas/particulate solids mixture into the tubular member whereby the interior wall of the tubular member guides the gas/particulate solids mixture along the tubular member, interiorly thereof in a direction away from the entrance end, and in generally surrounding relationship to the conveying tube such that at least a portion of the particulate solids are entrained in and accelerated by the liquid medium from the first nozzle means. Means are also provided for moving the conveying tube and the head assembly axially along the interior of the tubular member to effect cleaning of the interior wall.

In another embodiment of the present invention, there is provided a method of cleaning the interior of a tubular member having an entrance end and an interior wall. In the method, a pressurized liquid medium is introduced into the tubular member such that the liquid medium is accelerated from an acceleration locus in the tubular member. A pressurized gas/particulate solids mixture is introduced into the tubular member and is guided by the interior wall in a direction away from the entrance end into the tubular member. The liquid medium is accelerated in a direction at an angle of 90° or less to the direction of flow of travel of the gas/particulate solids mixture through the tubular member. The liquid medium and the gas particulate solids mixture are maintained separated from one another until at least a portion of the particulate solids moving through the tubular member are entrained in and accelerated by the liquid medium from the acceleration locus. The method also includes moving the acceleration locus axially along the interior of the tubular member to effect cleaning throughout the length of the tubular member.

DESCRIPTION OF THE DRAWINGS

FIG. 1 is a perspective representation of a system for cleaning tubular members such as the tube bundle of a heat exchanger in accord with the present invention;

FIG. 2 is an elevational view, partly in section, of a side entry packoff in accord with the present invention;

DESCRIPTION OF THE PREFERRED EMBODIMENTS

Figure 3:
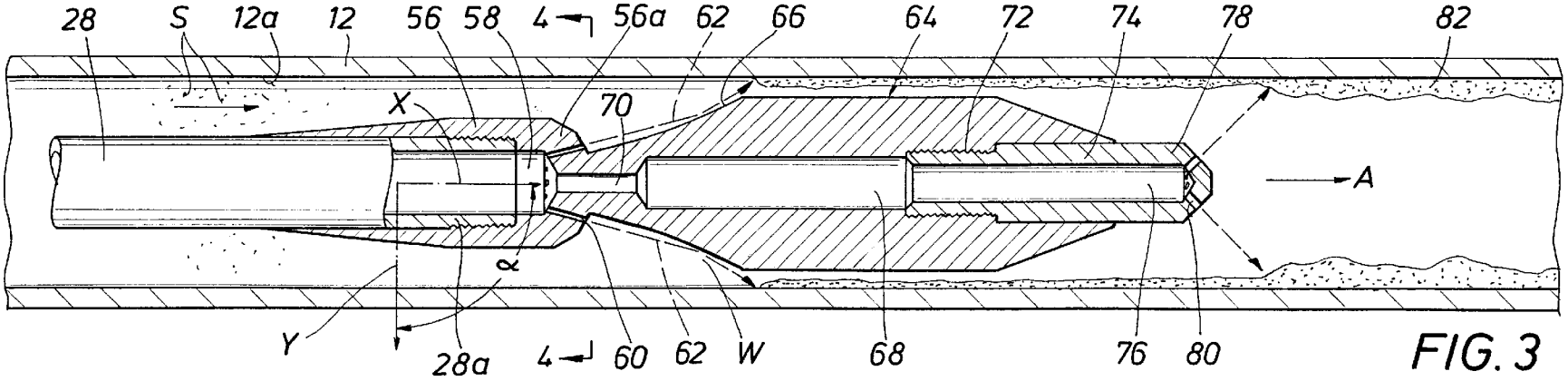
FIG. 3 is a fragmentary, elevational view, partly in section, of a first head assembly for use in one embodiment of the present invention.
Figure 6:
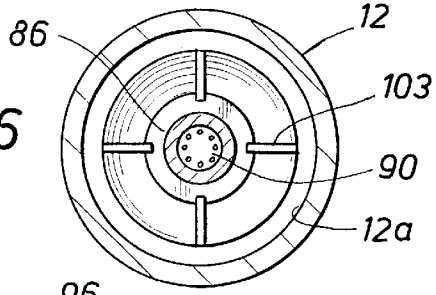
FIG. 6 is a view taken along the lines of 6—6 of FIG. 5.

With reference first to FIG. 1, there is shown a typical heat exchanger bundle 10 of a conventional tube-shell exchanger, the bundle comprising a plurality of tubes 12, each tube 12 having an interior wall 12*a* (see FIG. 2). The heat exchanger bundle 10 includes a header plate 14 having a series of apertures 16 that provide entrances into the tubes 12. Disposed in one of the tubes 12 (it being understood all such tubes would be cleaned) is a conveying tube and head assembly described more fully hereafter that in turn is connected to a manifold 18, described more fully hereafter with reference to FIG. 2.

Connected to manifold 18 is a conveying line 20 that leads to a vessel 22 containing a particulate solid (abrasive)—e.g., a water-soluble solid, sand, or some other such abrasive. The solids in vessel 22 are pressurized by means of a compressor 24 that supplies a compressed gas—e.g., air—to tank 22 via line 26.

Also connected to manifold 18 is a conveying tube 28 that in turn is connected to a hose or similar conduit 30 by a suitable coupling 32, hose 30 being connected to the output of a pump 34 that draws and pressurizes a liquid medium—e.g., water—from a tank 36 via line 38.

With reference to FIG. 2, it can be seen that the manifold 18 comprises a tubular housing 40 having a side entry nipple 42, housing 40 being provided with a throughbore 44, nipple 42 being provided with a port 46 that communicates with throughbore 44. Nipple 42 is connected to line 20 by a suitable coupling 48 whereby a gas/particulate solids mixture from vessel 22 can be delivered through port 46 and then into throughbore 44. Conveying tube 28 extends through a compressible packing 50, which can be urged into sealing engagement with tubular body 40 and conveying tube 28 by means of a threaded cap 52 threadedly received on housing 40 and having an opening 54 through which conveying tube 28 extends. Tubular housing 40 is also provided with a resilient sealing cap 54 that provides a seal between header plate 14 and tubular housing 40.

As can be seen from FIG. 2, with compressor 24 in operation, a pressurized gas/particulate solids mixture will be introduced via port 46 of nipple 42 into bore 44 and then into the interior of tubular member 12, where it will be guided through tubular member 12 by interior wall 12*a*. At the same time, with pump 34 in operation, liquid medium—i.e., water—will be introduced into conveying tube 28.

Figure 4:
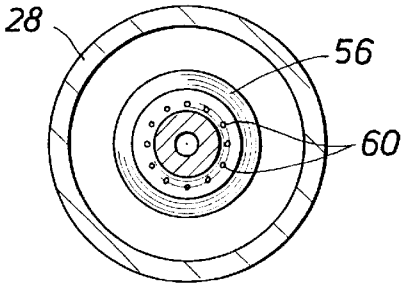
FIG. 4 is a view taken along the lines of 4—4 FIG. 3.

In reference now to FIG. 3, conveying tube 28 is shown as having a first end 28*a* that is threaded and on which is received a nozzle body 56, nozzle body 56 having an axially extending bore 58 that is in open communication with conveying tube 28. As best shown in FIG. 4, nozzle body 56 is provided with a series of circumferentially spaced ports that extend through a head portion 56*a* of nozzle body 56. As seen, ports 60 are angled generally radially outwardly so as to impart a radially outward direction vector to liquid medium flowing therethrough (see dotted arrows 62).

Integrally formed (but not necessarily so) with nozzle body 56 is a nose portion shown generally as 64. Nose portion 64 extends axially forward of nozzle head 56*a* and includes a generally frustoconical surface 66 that acts as a deflecting or directing surface and, in cooperation with ports 60, enhances the radially outward pattern of liquid medium passing through ports 60. As seen, deflecting surface 66 is not a true frustoconical surface but has an annularly extending, shallow concavity to aid in creating a more pronounced radially outward direction of flow. However, for purposes herein, the surface 66 will be described as substantially frustoconical.

Nose portion 64 includes an axially extending passageway 68 having a reduced diameter portion 70 that is in open communication with bore 58 in nozzle body 56. Received in a threaded counterbore 72, co-axial with passageway 68, is a tubular nozzle plug 74 having an axially extending bore 76 in open communication with passageway 68. Nozzle plug 74 has a head portion 78 that is provided with a plurality of circumferentially spaced ports 80, ports 80 being angled generally radially outwardly so as to accelerate liquid medium moving therethrough in a generally radially outward pattern. In effect, nozzle body 56 and nose portion 64 form a head assembly.

Figure 7:
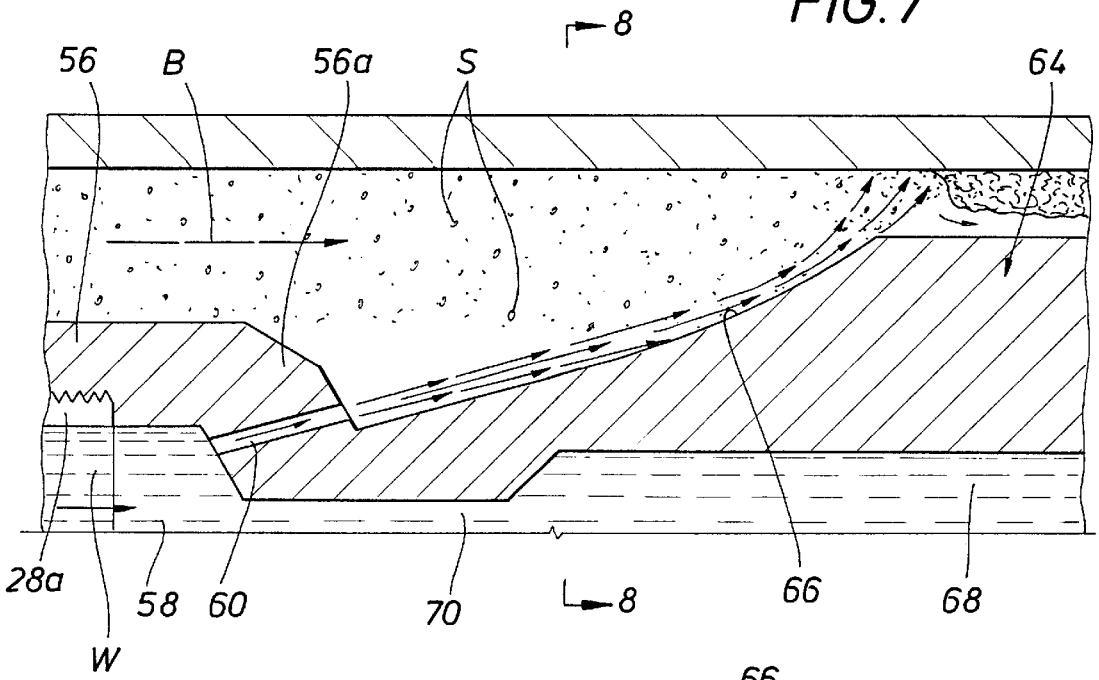
FIG. 7 is an enlarged, fragmentary view, partly in section, showing the interaction of the liquid medium and the particulate solids using the head assembly shown in FIG. 3.
Figure 8:
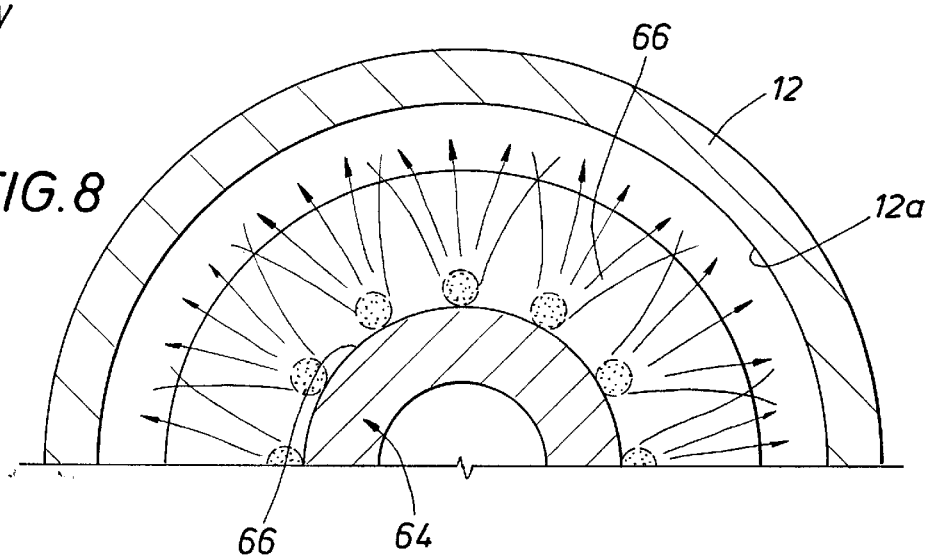
FIG. 8 is a view taken along the lines 8—8 of FIG. 7.

With reference to FIGS. 3, 7, and 8, the operation of one embodiment of the apparatus of the present invention can be demonstrated. It will be understood that conveying tube 28 is moved axially along the interior of tubular member 28, either manually or by some mechanical system well known to those skilled in the art to effect cleaning throughout the length of tube 28. As seen in FIG. 3, conveying tube 28 is moved in the direction of arrow A. As it so moves, and under the assumption that pump 34 and compressor 24 are in operation, the liquid medium supplied via conveying tube 28 will pass through bore 58, passageway 68, 70, and bore 76 and be accelerated radially outwardly through ports 80 of nozzle plug 78. The accelerated liquid medium upon impacting deposit 82—e.g., scale, rust, etc.—will dislodge a portion (see FIG. 3), the dislodged debris generally being moved down tube 28 in the direction of arrow A. As can be seen, however, a portion of the deposit still remains on the interior wall 12*a*.

To remove the remaining deposit 82, reference is now made to FIGS. 7 and 8. The pressurized gas/particulate solids mixture introduced into tubular member 12 through manifold 18 is guided by interior wall 12*a* in the direction of arrow A and in generally surrounding relationship to conveying tube 28. This is best shown in FIG. 7 where arrow B indicates the direction of flow of the gas/particulate solids mixture, the particulate solids being indicated as S. Liquid medium W jetting from ports 60, as best seen in FIG. 7, is accelerated in a generally radially outward pattern toward interior wall 12*a*. As the liquid medium W exits port 60, it soon contacts deflecting surface 66, which enhances the radially outward vector of liquid medium W and also helps to maintain the accelerated liquid medium W issuing from port 60 in a coalesced form such that a substantially annular, high velocity (1600–2000 mph) film of liquid medium W is forced against interior wall 12*a*. Indeed, it is believed that the combined action of ports 60 (which act as jets) and deflecting surface 66 serve to form a substantially coalesced frustoconical, high velocity, relatively thin sheet of liquid medium W that impacts interior wall 12*a* (see FIG. 8). It will be appreciated that the elapsed time between liquid medium W issuing from port 60 and impacting interior wall 12*a* is in the order of milliseconds because of the high velocity of the issuing liquid medium and the relatively short distance between the ports 60 and interior wall 12*a*.

Nozzle body 56 can thus be considered to form an acceleration locus interiorly of tubular member 12 through which liquid medium from conveying tube 28 is accelerated in a radially outward direction at any desired location in tubular member 12 simply by moving conveying tube 28 longitudinally through tubular member 12. It will also be appreciated that the gas/particulate solids mixture is not in contact with the liquid medium W until it enters the acceleration locus created by nozzle body 56. Thus, at least some of the particulate solids S present in the gas/particulate solids mixture are entrained and accelerated by the liquid medium issuing from ports 60 just prior to the mixture of particulate solids and liquid medium W impacting the interior wall 12*a* of tubular member 12. In effect, the particulate solids S and the liquid medium W are admixed just prior to the mixture of the two impacting the interior wall 12*a* of tubular member 12. Essentially, there is an in situ forming of a slurry of particulate solids in liquid medium W virtually at thc point of impact with the member being cleaned—i.e., wall 12*a*. As can be seen with reference to FIG. 3, the remaining deposit 82 is removed from the interior wall 12*a* of tubular member 12. In the latter regard, it should be noted that from the initial action of the liquid medium W issuing through ports 80, a portion of the deposit 82 is removed. This initial removal of deposit tends to roughen the residual deposit 82, making it more amenable to attack by the particulate solids/water slurry described above. It should also be observed that the combined action of liquid medium jetting through ports 80 and 60 also serves to act as an educting means to accelerate the gas/solids mixture through tubular member 12—i.e., the gas/solids mixture entering tubular member 12 is actually accelerated to a certain extent such that the solids moving through tubular member 12 and in generally surrounding relationship to conveying tube 28 tend to scour wall 12*a* as they move toward nose portion 64. Likewise, the water issuing from ports or jets 80 acts to educt the slurry through the annulus between nose portion 64 and interior wall 12*a* of tubular member 12, imparting enhanced cleaning action by the slurry.

It is believed that at least a portion of the solid particles S impacting the sheet of water issuing from ports 60, rather than being entrained in the water, simply impinge upon the sheet of water, lose no velocity and are accelerated virtually to the velocity of the water, and accordingly impact the wall 12*a*, not as a slurry, but simply as a solid travelling virtually at the velocity of the slurry. The net effect of using the apparatus and method of the present invention is that the liquid medium W itself acts to remove deposits, the combined slurry of liquid medium and solids act to remove deposit, and the particulate solids themselves act to remove deposit.

Figure 5:
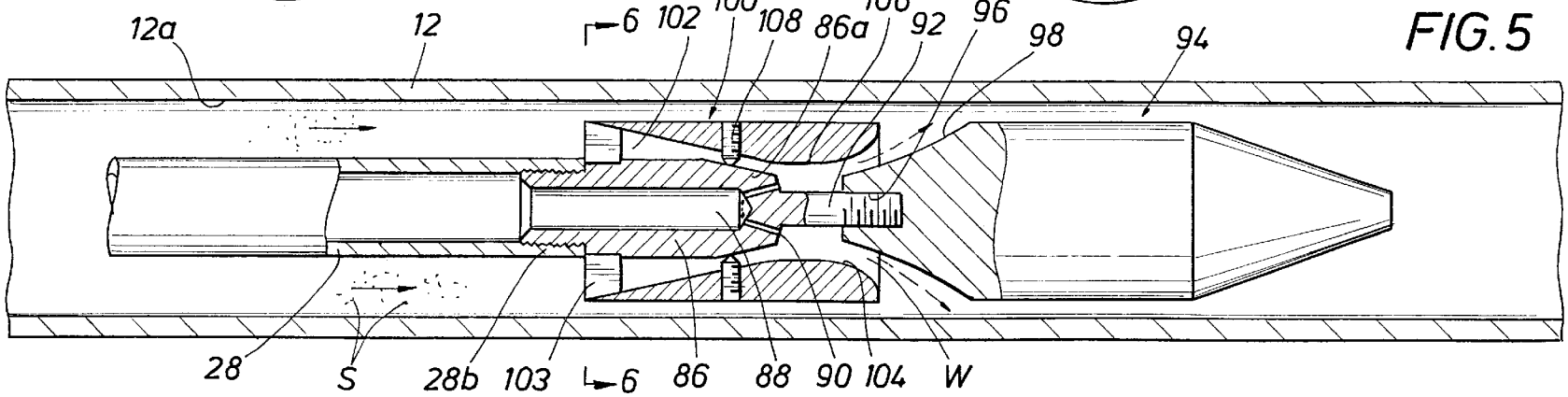
FIG. 5 is a fragmentary, elevational view, partly in section, of a second head assembly for use in a second embodiment of the present invention.
Figure 9:
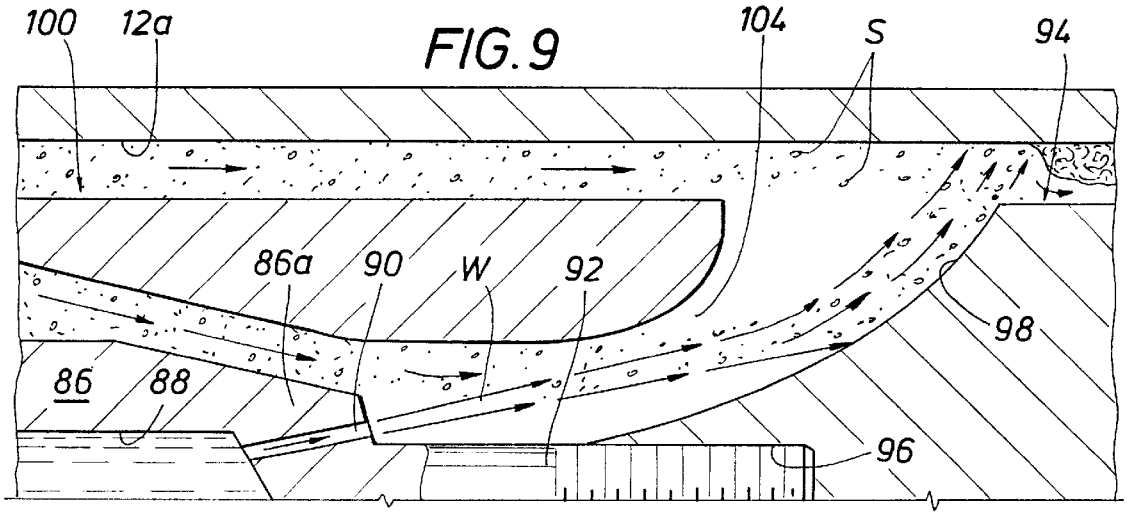
FIG. 9 is an enlarged, fragmentary view, partly in section, showing the interaction of the liquid medium and the particulate solids using the head assembly shown in FIG. 5.

Reference is now made to FIGS. 5 and 9 for the construction and operation of another embodiment of the present invention. Conveying tube 28 is provided with a first end 28*b* that differs from first end 28*a* in that while the latter is exteriorly threaded, the former is interiorly threaded. Received in threaded end 28*b* is nozzle body 86 having a throughbore 88 that, as seen, is in open communication with conveying tube 28. Nozzle body 86 is provided with a nozzle body head 86*a* through which extends a plurality of circumferentially spaced, radially outwardly angled ports 90, ports 90 being in open communication with throughbore 88. Nozzle head 86*a* has an axially forward projecting threaded stud 92. A nose portion 94, which is shown as substantially solid, has a threaded bore 96 that cooperates with threaded stud 92 whereby nose portion 94 can be removably secured to threaded stud 92. Nose portion 94 includes a deflecting surface 98, which, like deflecting surface 66, is generally frustoconical.

Disposed in surrounding relationship to nozzle body 86 is a collar shown generally as 100. Collar 100 is secured to nozzle body 86 by means of support ribs 103 and set screws 108 in the manner shown in FIG. 5. Collar 100 generally defines a venturi tube having an inlet end 102, an outlet end 104, and an intermediate throat section 106. As can be seen, liquid medium jetting from ports 90 exit ports 90 substantially at throat section 106.

As can be seen, a portion of the gas/particulate solids mixture passing through tube 12 enters inlet 102 of collar 100, a portion passing between the interior wall 12*a* and collar 100. The portion of the gas/solids mixture that enters collar 100 passes into the throat section 106, where it is first contacted with liquid medium jetting from ports 90. The solids S become entrained in and accelerated by the liquid medium W, the combined mixture (slurry) being accelerated radially outwardly against wall 12*a* by a combination of the direction of the ports 90 and deflecting surface 98. As in the case of the embodiment shown in FIG. 3, there is in situ mixing of the particulate solids S and the liquid medium W to the extent that they are not admixed or slurried until virtually the point of impact upon the surface being cleaned—i.e., wall 12*a*. The slurry issuing from the exit end 104 of collar 100 also acts to accelerate the velocity of solids S moving through tubular member in the annular space between interior wall 12*a* and collar 100. Accordingly, an additional scouring action is provided by the substantially dry solids moving through the annulus.

As pointed out above, regardless of whether the embodiment of FIGS. 3 or 5 is employed, the conveying tube 28 and its associated head assembly can be moved axially through the tubular member 12 either manually or mechanically in a well-known fashion. In this regard, it will be appreciated that conveying tube 28 can either be stiff, in the form of a lance, or can be a flexible tubing, it only being necessary that conveying tube 28 have sufficient strength to handle the pressures of the liquid medium.

As previously noted, the apparatus of FIG. 3 provides an acceleration locus of the liquid medium that can be moved to any desired point along the length of tubular member 12 and at that point entrain and/or accelerate solid particles being conveyed through tube 12. The same is true for the embodiment of FIG. 5, which, as the embodiment of FIG. 3, provides a movable acceleration locus of liquid medium that can be moved axially through tubular member 12 as desired.

In employing the method of the present invention, the liquid medium can be water or various liquid organic compounds, depending upon the deposits being cleaned. Thus, liquid mediums comprising mixtures of water and water-soluble alcohols can be employed. In cases where the deposits or coatings on the wall contain organic soluble materials, it may be desirable to utilize liquid hydrocarbons as the liquid medium. The particulate solids can comprise a water-soluble compound, a water-insoluble compound, or a mixture thereof. For example, in the case of water-insoluble compounds, materials such as sand, pumice, particulate slag, etc., can be employed. Indeed, virtually any abrasive-type material can be used when it is desired to employ a water-insoluble particulate solid. In the case of water-soluble particulate solids, and as will be appreciated by those skilled in the art, a wide variety of compounds can be employed. Generally, however, it is preferable to select water soluble compounds that are inexpensive and, more importantly, non-toxic such that they can be flushed out of the pipes being cleaned into existing drains with no special handling or disposal techniques required. Non-limiting examples of suitable water-soluble solids that can be employed include alkali metal carbonates, such as sodium carbonate; alkali metal bicarbonates, such as sodium bicarbonate; alkali halides, such as sodium chloride; and mixtures thereof.

Although the pressurized gas will conveniently be air, it will be recognized that, if necessary, inert gases—e.g., nitrogen—can be employed if necessary.

The apparatus and method of the present invention provides a particularly effective method of cleaning tubular members such as small diameter tubes used to form tube bundles of heat exchangers of the tube-shell type. It will be appreciated, however, that virtually any tubular member can be cleaned using the apparatus and method of the present invention.

A unique and highly advantageous characteristic of the apparatus and method of the present invention is the fact that when water-soluble, so-called soft abrasives, are used, they have maximum effectiveness. In conventional prior art systems using water-soluble, soft abrasives, because such abrasives are soft and are water-soluble, and because slurries of such undergo considerable handling—e.g., storage, pumping, etc.—the sharp or angular cutting edges or surfaces of the solids are greatly blunted either by dissolution in the water or simply by attrition due to excessive grinding together. Accordingly, their cutting effectiveness is diminished. By using the apparatus and method of the present invention, those prior art problems are overcome. Since the solids—e.g., the water-soluble materials—are not contacted by the water until just prior to impact on the surface to be cleaned, minimum dissolution and eroding or attrition of cutting surfaces occurs. Thus, the present invention achieves all the advantages of being able to accelerate the solids (soft abrasive) to a high velocity, as can only be done with a liquid medium, while avoiding the disadvantages of having to use a pre-formed solids/liquid slurry, which because of storage, pumping, and general handling results in solids of greatly reduced abrasive character.

It will be apparent that the liquid medium issuing from the conveying tube can be accelerated in a direction at an angle of 90° or less to the direction of flow of liquid medium through the conveying tube or, stated differently, at such an angle to the direction of flow of the gas/solids mixture through the tubular member—i.e., along the long axes of the conveying tube and the tubular member. Thus, with respect to FIG. 3, wherein dotted arrow x represents the direction of flow of the liquid medium in the conveying tube 28 and dotted arrow y indicates a direction at 90° to dotted arrow x, it will be apparent that the liquid medium issuing from tube 28 can be accelerated in a direction at an angle $\alpha$, determined by dotted arrows x and y, which is 90° or less. Thus, the term "radially outwardly" or "radially outward," as used herein, refers to a direction of flow of liquid medium that is at an angle a that is 90° or less, but greater than 0°. In point of fact, the acceleration of the liquid medium can occur at 90° to the direction of flow of a liquid medium in the conveying tube 28, at 0° to the direction of flow—i.e., parallel to the direction of flow of the liquid medium in conveying tube 28 or at any angle therebetween. As a practical matter, the angle of the direction of flow of the accelerated liquid medium from conveying tube 28 will generally be greater than 0° and less than 90°. Usually, the angle $\alpha$ will be from about 10° to about 60°. It should be understood, however, that even if the angle $\alpha$0 were 0°—i.e., if the direction of flow of the accelerated liquid medium from conveying tube 28 were parallel to the direction of flow of the liquid medium in tube 28—the present invention would still provide advantages in that as the jet of liquid medium issued from conveying tube 28 at an angle $\alpha$ of 0°, it would eventually expand radially outwardly in a cone-like pattern and begin to entrain solid particles from the gas/solids mixture in the manner described above. At the same time, the expanding cone of liquid medium would push air downstream out the end of tubular member 12, reducing the back pressure upstream and thereby aiding and accelerating the solid particles in the gas/solids mixture moving through the tubular member being cleaned. If the accelerated liquid medium issuing from conveying tube 28 were at an angle $\alpha$ of 90° to the direction of the flow of liquid medium in tube 28, there would still be some acceleration of the solid particles that were entrained by the liquid medium before it impacted the interior wall of tubular member 12. It will be apparent, however, that best results will be obtained, as noted above, when the angle of the direction of the accelerated liquid medium leaving tube 28 is less than 90°, but greater than 0°.

The foregoing description and examples illustrate selected embodiments of the present invention. In light thereof, variations and modifications will be suggested to one skilled in the art, all of which are in the spirit and purview of this invention.

What is claimed is:

1. A method of cleaning the interior of a tubular member having an entrance end and an interior wall, comprising:

introducing a conveying tube into said tubular member to form an annulus between said conveying tube and said tubular member, said conveying tube having a nozzle defining an acceleration locus interiorly of said tubular member;

introducing a pressurized liquid medium into said conveying tube such that at least a portion of said liquid medium is accelerated from said acceleration locus in a direction so as to impact said interior wall of said tubular member;

introducing a pressurized gas/particulate solids mixture into said annulus, said gas/particulate solids mixture being guided by said interior wall in a direction away from said entrance end into said tubular member, said liquid medium being accelerated in a direction at an angle measured in the direction of flow of said gas/particulate solids mixture of 90° or less to the direction of flow of said gas/particular solids mixture, an in situ slurry of at least a portion of said liquid medium and at least a portion of said solids being formed just prior to said liquid medium's impacting said interior wall, said liquid medium and said pressurized gas/particulate solids mixture being separated from one another until at least a portion of said particulate solids are entrained in and accelerated by said liquid medium from said acceleration locus; and moving said acceleration locus axially along the interior of said tubular member.

2. The method of claim 1 wherein said angle is greater than 0°.

3. The method of claim 1 wherein said angle is from about 30° to about 60°.

4. The method of claim 1 wherein said gas comprises compressed air.

5. The method of claim 1 wherein said particulate solids comprise a water-soluble compound.

6. The method of claim 1 wherein said particulate solids are selected from the class consisting of water-soluble alkali metal carbonates, alkali metal bicarbonates, alkali halides, and mixtures thereof.

7. The method of claim 1 wherein said particulate solids comprise a substantially water-insoluble compound.

8. The method of claim 1 wherein said liquid medium comprises water.

* * * * *